United States Patent [19]

Moura et al.

[11] Patent Number: 4,549,169

[45] Date of Patent: Oct. 22, 1985

[54] PERSONAL OCEAN SECURITY SYSTEM

[75] Inventors: Michael Moura, Fairhaven; Lenine Gonsalves, North Dartmouth; Gilbert Fain, Seekonk, all of Mass.

[73] Assignee: Kelmar Marine Inc., Fairhaven, Mass.

[21] Appl. No.: 447,302

[22] Filed: Dec. 6, 1982

[51] Int. Cl.[4] ..... G08B 1/08; G08B 23/00

[52] U.S. Cl. ..... 340/539; 340/573

[58] Field of Search ..... 340/573, 539

[56] References Cited

U.S. PATENT DOCUMENTS

| | | | |
|---|---|---|---|
| 3,810,146 | 5/1974 | Lieb | 340/539 X |
| 4,056,815 | 11/1977 | Anderson | 340/539 |
| 4,079,364 | 3/1978 | Antenore | 340/539 X |
| 4,305,143 | 12/1981 | Simms et al. | 340/573 X |
| 4,442,426 | 4/1984 | Heuschmann et al. | 340/539 |

FOREIGN PATENT DOCUMENTS

| | | | |
|---|---|---|---|
| 2641843 | 3/1978 | Fed. Rep. of Germany | 340/573 |
| 2498783 | 7/1982 | France | 340/539 |

*Primary Examiner*—Anthony V. Ciarlante

*Attorney, Agent, or Firm*—Weingarten, Schurgin, Gagnebin & Hayes

[57] ABSTRACT

A system for monitoring the security of one or more persons in a waterside environment and for providing a failure proof indication of when such person falls into the water. The system includes a portable transmitter worn about the body of the person whose security is being monitored in a location which insures its submergence when the person falls into the water. Transmissions from the portable unit, which may be either time shared or the result of an interrogation from a base station, are monitored at a base station. Continuous presence of the transmitted signal from each portable unit inhibits an alarm condition at the base station, but if the transmitted signal is not received, or is not received for a predetermined time period, the alarm condition is activated and the portable unit not transmitting is identified. The lack of a transmitted signal indicates a "man overboard" condition resulting from the transmitter being immersed in the water and transmissions thus blocked. A low battery condition is also transmitted by the portable unit and when received by the base station provides a corresponding identification of the affected portable unit allowing recharging before the battery completely fails. A cradle is provided to hold each portable unit for recharging and to permit synchronization of a timer in the portable unit that controls the transmission timing.

21 Claims, 8 Drawing Figures

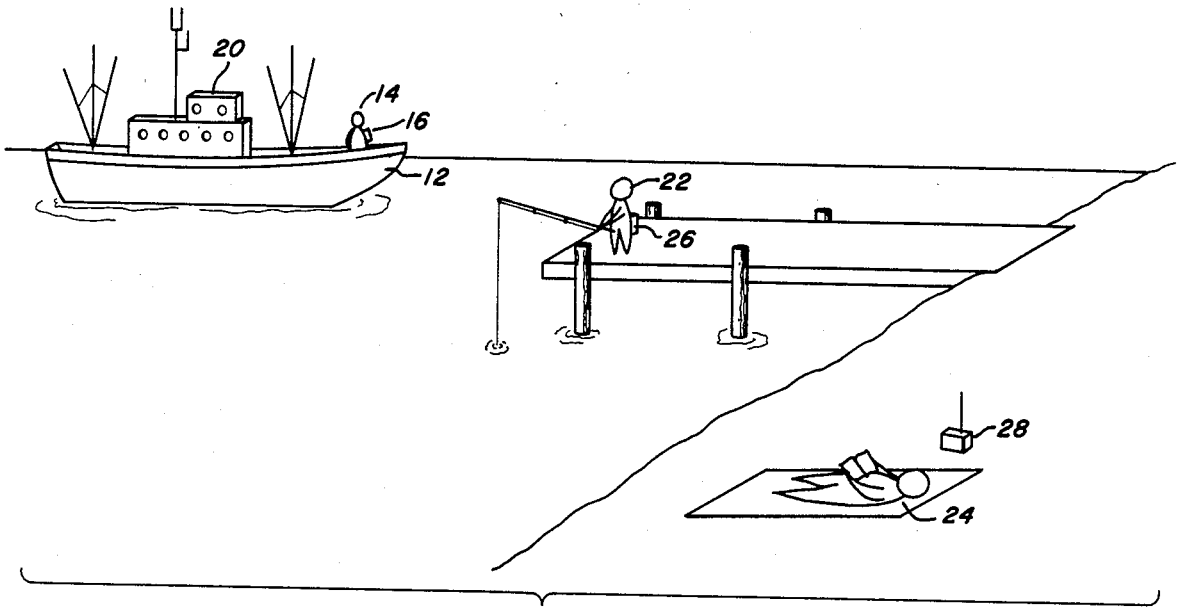
FIG. 1
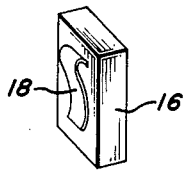
FIG. 2
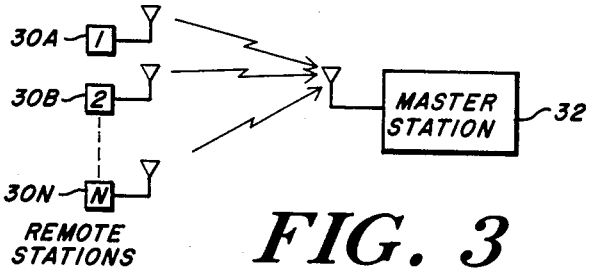
FIG. 3
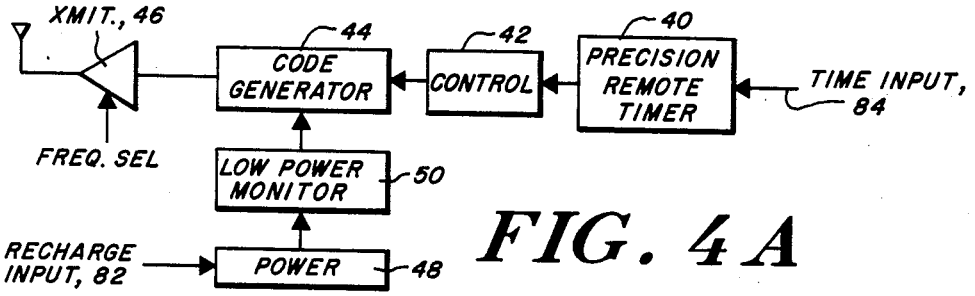
FIG. 4A
FIG. 4B
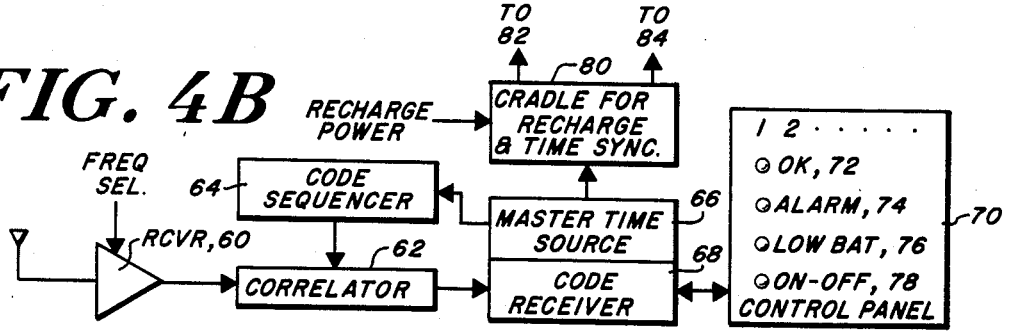

PERSONAL OCEAN SECURITY SYSTEM

FIELD AND BACKGROUND OF THE INVENTION

The present invention relates to the field of personal safety systems and in particular to a system for indicating when a crewman, child or other person in a waterside environment accidentally enters the water. There are many instances when young children, playing near the water, cannot be continuously observed by adults or when adult attention is diverted for a period of time often sufficient to permit the child to accidentally fall into the water. A serious accident may result if the attending adult is not immediately summoned. The crew of many ships are also exposed to the risk of accidentally falling into the water while unobserved. This is particularly true of fishing vessels where crew activity takes place around the railing, hauling and setting fishing gear. On any vessel at night there exists an increased danger to crewmen from falling overboard due to the higher chance that the accident will go unobserved.

Systems exist for detecting a "man overboard" situation and operate by, for example, receiving an ultrasound signal transmitted through the water upon submergence of a transmitting unit which is worn about the body of an individual to be protected and activated by immersion of the individual. Such systems depend for their reliability on the activation of the transmitter upon immersion of the individual. In situations involving strenuous physical work by crewmen or the intervention of curious children, the possibility of a failure to activate the transmitting mechanism exists. The results of such a failure, particularly where the security system is relied upon to the exclusion of traditional safety measures, could be tragic.

SUMMARY OF THE INVENTION

In accordance with the teaching of the present invention a substantially failsafe system of personal security at waterside is provided in which monitoring of safety relies upon continuous transmission of a signal from a portable unit worn by each person being checked. Immersion of the portable unit with the individual blocks the transmission, causing an overboard alarm condition. In the absence of immersion of the portable unit a signal is transmitted from each portable unit uniquely identifying it to the base station and providing and "all is well" indication.

Each portable unit also has a power source monitor that detects when it is nearing exhaustion, such as a low battery detector, and causes transmission of a corresponding indication to the base station which interprets the signal and announces the low power condition of the appropriate unit so that it can be replaced before a false alarm is generated.

In one embodiment of the invention, the portable unit includes a code generator and time sequencer, that is synchronized periodically when the unit is placed on battery recharge, to define a time period for transmission of the generated code at repeating periods that are unique to each unit. The base station includes a code detector that identifies the code for each unit to confirm that the wearer is still out of the water. A code corresponding to the low battery condition is also generated at the portable unit and is transmitted with the unique, unit identifying code whenever a low power condition is present.

In another embodiment of the invention, the base station transmits, at distinct time intervals, codes unique to each of the portable units which, upon reception by the portable units, initiates the retransmission of a unique, unit identifying code, to the base station as an "all is well" signal. A low power signal is also applied to the outgoing transmissions to the base station.

The base station includes means for accumulating the number of times that a signal is not received from a portable unit before initiating an alarm condition. The transmissions are produced at radio frequencies, the only requirement being that the wavelength be subject to substantial attenuation when the originating source is immersed in water.

The system optionally includes apparatus for disabling the motive power of any vessel aboard which the system is employed. This is particularly useful in situations involving small crews.

DESCRIPTION OF THE DRAWINGS

These and other features of the invention are more fully set forth below in the solely exemplary detailed description and accompanying drawing of which:

FIG. 1 is a pictorial view of the invention in use in an exemplary setting;

FIG. 2 is a pictorial view of a portable unit of the invention;

FIG. 3 is a general block diagram of a first embodiment of the invention;

FIG. 4A is a diagram of a portable unit according to the first embodiment of the invention;

FIG. 4B is a diagram of a base station according to the first embodiment of the invention;

DETAILED DESCRIPTION

Figure 5:
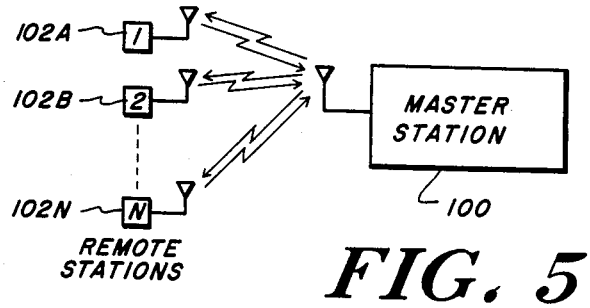
FIG. 5 is a general block diagram of a second embodiment of the invention.

The present invention contemplates a system for monitoring the status of individuals active near the water to identify when they may accidentally fall in the water.

With reference to FIG. 1, the setting of the invention is illustrated, showing a vessel 12 having a crew member 14 wearing a portable transmitting unit 16. The unit 16 is more fully illustrated in FIG. 2 to include a belt-carried transmitter or transceiver supported from a belt clip 18. The unit 16 transmits to a central or base station, for example within a wheel house 20, where continued reception of signals is monitored as an indication of the safety of the crewman 14.

The invention is also applicable to monitoring the safety of children, such as child 22, engaged in waterside activities while an attending adult 24 is engaged in other activities which may make it difficult to keep a visual guard on the child 22. The child 22 wears a portable transmitting unit 26 which transmits to a base station 28 a signal indicative of the continuing safety of the child; that is that the child has not fallen into the water.

In the event that either the crewman 14 or the child 22 should accidentally fall into the water, transmissions from the respective units 16 and 26 are extinguished by the intervening water medium. The absence of signals from the portable units 16 and 26 are interpreted by the base stations as an indication of an alarm condition and an appropriate alarm is generated.

As illustrated in FIG. 2, one or more portable transmitting units 30A, 30B, . . . 30N are provided to transmit to a single base station 32 in a first embodiment. The portable transmitting units 30A, 30B, . . . 30N are more fully illustrated in FIG. 4A to include a precision timer 40 which maintains synchronization with the timing circuitry of the base station 32 to be described below. A control circuit 42 identifies a repeating time period unique to the particular unit 30A, 30B, . . . 30N to activate a code generator 44 during that time period to apply a code unique to that portable unit to a modulating input of a transmitter 46. There results the transmission of a signal from each unit 30A, 30B, . . . 30N that uniquely identifies that unit and is provided only in the corresponding time period to avoid interference.

A power source 48 for the unit, in addition to powering the unit, has its power level detected by a low power monitor 50. When the monitor 50 detects that the power source is nearing exhaustion, it activates the generator 44 to provide a modulating signal that identifies that condition for transmission to the base station.

The base station includes a receiver as shown in FIG. 4B having a radio frequency front end 60 that receives and demodulates the code transmissions from the portable units 30A, 30B, . . . 30N. The demodulated signal comprises a sequence of the codes unique to each portable unit that continuously repeats. That demodulated signal is applied to a correlator 62 along with a sequence of the expected codes from a code sequencer 64. The codes provided by the code sequencer 64 are generated with the same timing as the codes generated in each portable unit by a master time source 66. The correlator 62, receiving both the internally generated expected code stream and the actually transmitted code sequence, operates to detect coincidence between these two inputs. Such correlation functions are known in the art and effectively involve a multiplication of the two inputs. The output of the correlator 62 is applied to a code receiver 68 which detects a lack of correlation in the output of the correlator 62, indicating a unit that failed to transmit a code, and identifies the nontransmitting unit by the timing of the uncorrelated output. The code receiver 68 applies a signal identifying a nontransmitting unit to a control panel 70. The panel 70 includes a set of lights 72, 74, 76, one of each for each portable unit and respectively labelled to identify an "OK", "ALARM", and "LOW BATTERY" condition for each unit. A switch 78 is provided to enable or disable the lights for any unit, avoiding the monitoring function for any portable unit not in use. In the absence of detection of an uncorrelated signal from the code receiver 68, the light 72 for each enabled unit is activated. When an indication of a nontransmitting unit is provided by the code receiver 68 detecting a lack of correlation for an identified unit, the light 74 for that unit is activated on the panel 70. As noted above, each portable unit transmits a code in its assigned time slot to indicate a low battery condition which is detected by the code receiver as a predetermined correlation indication from the correlator 62. The code receiver identifies the transmitting unit by the time of occurrence of the low battery code and illuminates the corresponding light 76 on the panel 70. Other forms of indicators may be used as desired.

A cradle 80 is provided at the base station to hold any portable units not in use. The cradle includes a connection 82 to the units power source 48 to provide recharging of it while on the cradle. The precision remote timer 40 of each portable unit has a time synchronization input 84 from the cradle to keep the timer 40 synchronized at all times to the master time source 66. The time period of use for each portable unit is sufficiently short that synchronization can be maintained adequately by the unit timers 40 during that period using conventional oscillators. The distance over which transmissions occur is also sufficiently small that propagation delays will not affect the timing. A typical time period for repetition of all codes is approximately two seconds times the number of transmitters in use.

Both transmitting and receiving units 46 and 60 may be provided with a selection of frequencies, typically 64, to permit interference avoidance. The typical transmission range is nevertheless kept short enough to limit the interference distance to a few hundred yards.

A second embodiment of the invention uses portable units which transmit an identifying "all is well" code only in response to an interrogating signal received from a base station. Such a system is illustrated in general in FIG. 5 where a base station 100 both receives transmissions from and sends interrogating transmissions to a set of portable units 102A, 102B, . . . 102N.

Figure 6A:
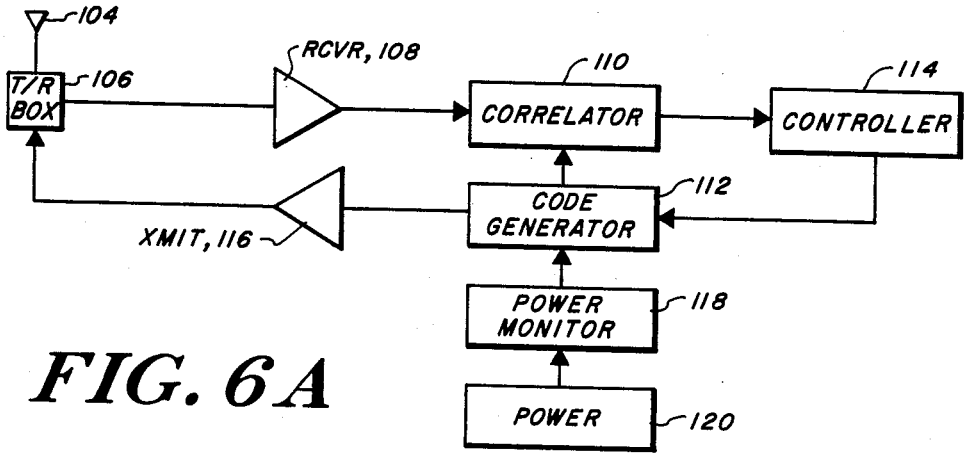
FIG. 6A is a diagram of a portable unit according to the second embodiment of the invention.

The portable unit according to the embodiment of FIG. 5 is illustrated in FIG. 6A. A unit antenna 104 receives or transmits through an antenna switch 106. Interrogating signals from the base station are detected in a receiver 108 from the antenna and applied to a correlator 110 along with a code generated in a local code generator 112. The correlator 110 operates as described above to detect reception from the base station of a code unique to that unit. Where such a code is detected, indicating a request for transmission, a controller 114 detects reception of the appropriate code and activates the code generator 112 to apply the unique unit code to a transmitter 116, along with a low power code from a power monitor 118 for power source 120 as applicable.

Figure 6B:
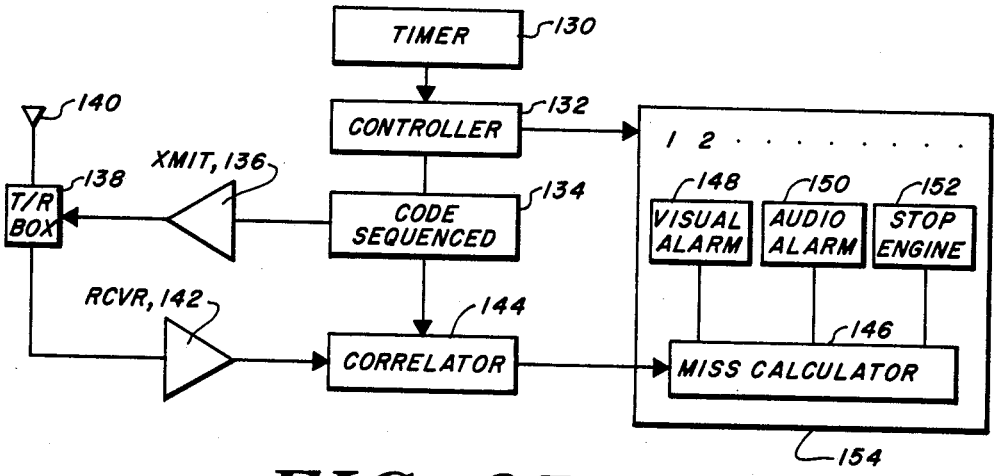
FIG. 6B is a diagram of a base station according to the second embodiment of the invention.

The base station is illustrated in FIG. 6B. A timer 130 sequences a controller 132 through a set of states each of which activates a code sequencer 134 to apply each units unique code in a repeating pattern to a transmitter 136 for transmission through an antenna switch 138 to an antenna 140. Assuming that the intended unit receives its unique code and responds with a retransmission of its code, that signal is received through the antenna switch 138 by a receiver-detector 142. The demodulated code is applied to a correlator 144 along with the previously transmitted code, delayed a period corresponding to the known response time of the portable unit. The output of the correlator, having the characteristics indicated above, is applied to a miss calculator 146 which operates to detect a predetermined number of times that the addressed unit fails to respond in succession. If that number of failures is reached, the calculator 146 causes activation of a visual alarm 148, audio alarm 150, or engine stop system 152. Timing signals from the controller 132 identify to a control panel 154 the unit being interrogated by the time period in which the signals are processed. Typically the calculator 146 and alarms and engine control systems are located within a control panel 154 as described above.

The system described above provides a personal waterside security system having a substantially failure free detection of an accidental fall into the water. The described system is exemplary of the invention; the actual scope of which is defined in the following claims.

What is claimed is:

1. Apparatus for monitoring the security of one or more persons in a waterside environment comprising:

one or more means for transmitting an individualized signal and adapted to be worn about the body of said one or more persons in a location insuring submergence of said transmitting means upon immersion of a person wearing it in the water;

said transmitting means transmitting said individualized signal in an emission band which is suppressed upon submergence of the transmitting means in the water;

means for receiving and recognizing transmitted, individualized signals, the recognition being of the identity of the originating transmitting means further comprising:

means for generating a master time signal;

means for generating a code signal according to the master time signal;

means for correlating the received transmitted, individualized signal with said code signal providing a correlator output signal upon correlation thereof; and code receiver means for determining the identity of the individualized signal from among all received transmitted, individualized signals;

means for generating an alarm condition in the absence of reception and recognition of an individualized signal corresponding to one of said one or more transmitting means; and means for suppressing the alarm condition in the presence a received and recognized signal.

2. The apparatus of claim 1 wherein:

said means for transmitting an individualized signal includes means for transmitting a unique coded signal having a code identifying said means; and means for transmitting a coded signal identifying low power level of said transmitting means.

3. The apparatus of claim 2 wherein:

plural transmitting means are provided;

each said transmitting means includes means for causing it to transmit its individualized signal in a unique, repeating time period so as to avoid interference with signals transmitted by the other of said plural transmitting means.

4. The apparatus of claim 3 wherein:

means are provided for cradling each said transmitting means and for synchronizing the timing of the transmission time period while the transmitting means is so cradled.

5. The apparatus of claim 4 wherein:

each said transmitting means is powered by a rechargeable power source; and means are provided for recharging said power source while the associated transmission means is in the cradle.

6. The apparatus of claim 1 wherein:

said receiving means includes means for transmitting a signal to one or more of said transmitting means having a characteristic unique to one of said one or more transmitting means;

said transmitting means having means for receiving the signal having the corresponding unique characteristic and, in response thereto, for causing transmission by said transmitting means of the individualized signal.

7. The apparatus of claim 1 wherein:

means are provided for causing operation of said alarm condition generating means only upon the existence of a predetermined history of absences of received and recognized individualized signals.

8. The apparatus of claim 7 wherein:

said predetermined history includes a predetermined number of failures to receive and recognize an individualized signal where expected.

9. The apparatus of claim 1 wherein:

said transmitting means includes means for providing operating power from a depletable source and for transmitting along with the individualized signal an indication of nearing depletion of said source;

said means for receiving and recognizing including means for providing an indication of a transmitting means for which an indication of nearing depletion is received.

10. The apparatus of claim 1 wherein:

said receiving and recognizing means is associated with a water bourn vessel; and means are provided for deactivating the vessel in response to the generation of an alarm condition.

11. The apparatus of claim 1 further including means for selecting one of a plurality of transmitting and receiving frequencies for said transmitting and receiving means.

12. A method for monitoring the security of one or more persons in a waterside environment comprising:

transmitting an individualized signal from said one or more persons from a location thereon insuring submergence of said location upon immersion of said person in the water;

transmitting said individualized signal in an emission band which is suppressed upon submergence of said person in the water;

receiving and recognizing transmitted, individualized signals, the recognition being of the identity of the originating person, comprising the steps of:

generating a master time signal;

generating a code signal according to the master time signal;

correlating the received transmitted, individualized signal with said code signal and providing a correlator output signal upon correlation thereof; and determining the identity of the individualized signal from among all received transmitted, individualized signals by a code receiver determined according to the timing of the absence of a correlator output signal;

generating an alarm condition in the absence of reception and recognition of an individualized signal corresponding to one of said one or more persons; and suppressing the alarm condition in the presence a received and recognized signal.

13. The method of claim 12 wherein:

said step of transmitting an individualized signal includes transmitting a coded signal having a code identifying said person.

14. The method of claim 13 wherein:

plural persons are provided; and said transmitting step includes the step of transmitting each person's individualized signal in a unique, repeating time period so as to avoid interference with signals transmitted from the other of said plural persons.

15. The method of claim 14 wherein:

the step is provided of maintaining the timing of the unique repeating time period.

16. The method of claim 15 wherein:

the step is provided of resupplying operating power for each transmission during inactive periods.

17. The method of claim 13 wherein:

said receiving step includes the step of transmitting a signal to one or more of said persons having a characteristic unique to one of said one or more persons;

said transmitting step including the step of receiving the signal having the corresponding unique characteristic and, in response thereto, causing transmission from said person of the individualized signal.

18. The method of claim 12 wherein:

a step is provided for generating said alarm condition only upon the existence of a predetermined history of absences of received and recognized individualized signals.

19. The method of claim 18 wherein:

said predetermined history includes a predetermined number of failures to receive and recognize an individualized signal where expected.

20. The method of claim 12 wherein:

said transmitting step includes a step of providing operating power from a depletable source and for transmitting along with the individualized signal an indication of nearing depletion of said source;

said step of receiving and recognizing including the step of providing an indication of a received transmission in which an indication of nearing depletion is received.

21. The method of claim 12 wherein:

said receiving and recognizing step is associated with a water bourn vessel; and a step is provided of deactivating the vessel in response to the generation of an alarm condition.

* * * * *